US006666663B2

(12) United States Patent
Lee et al.

(10) Patent No.: US 6,666,663 B2
(45) Date of Patent: Dec. 23, 2003

(54) GAS SUCTION APPARATUS FOR A RECIPROCATING COMPRESSOR WITH A PISTON INERTIA VALVE

(75) Inventors: Hyeong Kook Lee, Gunpo (KR); Hyung Jin Kim, Seoul (KR); Won Sik Oh, Seoul (KR); Hyuk Lee, Siheung (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/038,903

(22) Filed: Jan. 8, 2002

(65) Prior Publication Data

US 2003/0072657 A1 Apr. 17, 2003

(30) Foreign Application Priority Data

Oct. 15, 2001 (KR) ..... 2001-63422

(51) Int. Cl.[7] ..... F04B 17/03

(52) U.S. Cl. ..... 417/417; 417/552; 417/545; 417/555.1; 91/422; 137/533.31

(58) Field of Search ..... 417/417, 552, 417/545, 555.1; 91/422; 137/533.21, 533.31

(56) References Cited

U.S. PATENT DOCUMENTS 4,272,228 A * 6/1981 Kutik et al. ..... 417/460
5,073,095 A * 12/1991 Thomas, Sr. ..... 417/417
5,562,430 A * 10/1996 Schuller et al. ..... 417/545
5,993,178 A * 11/1999 Park et al. ..... 417/545
6,358,026 B1 * 3/2002 Palmore ..... 417/545
6,457,957 B1 * 10/2002 Bauer et al. ..... 417/562
6,497,560 B2 * 12/2002 Carlson ..... 417/553

FOREIGN PATENT DOCUMENTS

DE 693 04 002 T2 3/1997

OTHER PUBLICATIONS

Drees, Heinrich: Kühlanlagen, 15., bearb.Aufl.Berlin: Verlag Technik GmbH, 1992, Seite 140. ISBN: 3–341–00935–3.

* cited by examiner

*Primary Examiner*—Cheryl J. Tyler
*Assistant Examiner*—Emmanuel Sayoc
(74) *Attorney, Agent, or Firm*—Birch, Stewart, Kolasch & Birch, LLP

(57) ABSTRACT

A gas suction apparatus for a reciprocating compressor, including a piston having a gas flowing passage where refrigerant gas flows, being inserted in the compression space formed in a cylinder enabling linear reciprocating movement, a fixing means combined to the piston and an inertia valve inserted in the gas flowing passage of the piston movably having a moving distance restricted by the fixing means, for opening and closing the gas flowing passage moving according to the pressure difference and inertia generated by the linear reciprocating movement of the piston can minimize dead volume of a gas compression space, ease controlling of a stroke and make the suction flowing of gas smoothly by an excellent reliability of response of valve, thus to improve compression performance. The damage of the component can be also prevented by increasing structural strength, thus to improve reliability.

10 Claims, 6 Drawing Sheets

GAS SUCTION APPARATUS FOR A RECIPROCATING COMPRESSOR WITH A PISTON INERTIA VALVE

BACKGROUND OF THE INVENTION

1. Field of the Invention

The present invention relates to a compressing apparatus of refrigerant gas for a reciprocating compressor and particularly, to a gas suction apparatus for a reciprocating compressor capable of improving compressing performance of refrigerant gas and reliability of components.

2. Description of the Background Art

Generally, a compressor is an instrument for compressing fluid such as air and refrigerant gas. The compressor generally includes a driving unit installed in a closed container, for generating a driving force and a compressing unit for sucking and compressing refrigerant gas by receiving the driving force of the above driving unit and is classified into a rotary compressor, reciprocating compressor and a scroll compressor according to the structure of the compressing unit.

The reciprocating compressor among them is a compressor in which a driving force of the driving unit is transmitted to the piston and the piston sucks and compresses refrigerant gas performing linear reciprocating movement in a cylinder.

FIGS. 1 and 2 show an embodiment of the compressing unit of the reciprocating compressor and the compressing unit of the reciprocating compressor includes a cylinder 10 where a through hole 11 forming a compression space P inside the hole is formed, a piston inserted in the through hole 11 of the cylinder 10 enabling linear reciprocating movement and a discharge valve assembly 30 combined to the end portion of the cylinder 10 to cover the through hole 11.

The piston 20 has a head portion 22 at one side of the body portion 21 having a certain length and a connection portion 23 extended into a certain area at the other side of the body portion 21. In the body portion 21, a first gas passage 24 having a certain depth is formed in the body portion 21 and in the head portion, a second gas passage 25 is formed.

The first gas passage 24 is composed of a hole and the second gas passage 25 is composed of a plurality of through holes.

A suction valve 40 for opening and closing the second gas passage 25 is positioned in the head portion 22 and the connection portion 23 of the piston 20 is connected into the driving unit for generating a driving force.

On the other hand, the suction valve 40 is composed of a thin plate in a round form and has a dissection portion 41 is positioned inside the valve. The suction valve is divided into a fixing portion 42 and opening and closing portion 43 by the dissection portion 41.

The suction valve 40 is fixed-combined to the head portion 22 having a fixing bolt 50 penetrated by the fixing portion 42 under the condition that the valve is contacted on the end surface of the head portion 23 of the piston 20.

Also, the discharge valve assembly 30 includes a discharge cover 31 combined to cover the end portion of the cylinder 10, a discharge valve 30 inserted in the discharge cover 31, for opening and closing the compression space P formed by the through hole 11 and piston 20 of the cylinder 10 and a valve spring 33 for elastically supporting the discharge valve 32.

In the operation of the compressing unit of the above reciprocating compressor, first, a driving force of the driving unit is transmitted to the piston 20 and the piston 20 performs linear reciprocating movement in the cylinder 10.

In the process, as shown in FIG. 3, when the piston 20 moves to the direction of a bottom dead point a, the discharge valve 32 is contacted on the end portion of the cylinder 10 by pressure difference and blocks the compression space P. At the same time, the suction valve 40 combined to the piston 20 is bent and open the second gas passage 25, thus to suck refrigerant gas to the compression space P formed in the cylinder 10 through the first gas passage 24 and the second gas passage 25 of the piston 20.

When the piston 20 moves to an upper dead center (b) after reaching the bottom dead center (a), the suction valve 40 is restored to the former condition and the second gas passage 25 of the piston 20 is closed, thus to compress refrigerant gas sucked to the compression space P formed in the cylinder 10. When the piston 20 reaches the top dead center (b), the discharge valve 32 is opened and the compressed refrigerant gas is discharged.

As the above process is repeated continuously, refrigerant gas is compressed.

However, in the above structure, since the suction valve 40 formed as a thin plate is fixed-combined by the fixing bolt 50, the head portion of the fixing bolt 50 is positioned in the compression space P in the protruded form and accordingly, a dead volume is generated, thus to decline compressing efficiency. Also, position sensing of the top dead center (b) and bottom dead center (a) of the piston 20 is difficult and accordingly, controlling of a stroke of reciprocating movement of the piston 20 becomes difficult.

Since the suction valve 40 formed as a thin plate is combined by the fixing bolt 50, design of the second gas passage 25 is limited. Namely, in case the flowing cross section of the second gas passage 25 is large, the flowing cross section where the refrigerant gas flows becomes large. However, the suction valve 40 formed as a thin plate could be damaged by an excessive suction pressure in bending the valve and in case the size of the flowing cross section of the second gas passage 25 is small, the flowing resistance of refrigerant gas could be increased by the small cross section.

As the piston 20 moves, in the process that the suction valve 40 is repeated opened or closed, a slip rotation is generated between the suction valve 40 and the fixing bolt 50 and accordingly, compressing performance could not be performed well since the piston 20 is seceded from the second gas passage 25.

Also, as the suction valve 40 was bent and restored to its former state, the second gas passage 25 is opened or closed and accordingly, a fatigue crack is generated and a screw hole 44 for combining the fixing bolt 50 is formed at the bending portion of the suction valve 40. Therefore, structural strength was declined.

As a structure for making up for the above disadvantage, as shown in FIG. 4, an embodiment that the fixing portion 42 of the suction valve 40 is directly welded-connected to the end surface of the head portion 22 of the piston 20 is disclosed.

With such structure, the dead volume can be reduced and control of a stroke is eased but, characteristic of the material is changed by heat transformation by welding heat for welding the suction valve 40 on the head portion 22 of the piston 20. When the opening and closing operation of the suction valve 40 is continuously performed, cracks by fatigue are generated centering around the welding point, thus to decrease reliability of the compressor.

SUMMARY OF THE INVENTION

Therefore, the present invention provides a gas suction apparatus for a reciprocating compressor which can make the suction of refrigerant gas smoothly and increase structural combining strength.

Also, another object is to provide a gas suction apparatus for a reciprocating compressor which can minimize dead volume of a compression space of refrigerant gas and ease controlling of a stroke.

To achieve these and other advantages and in accordance with the purpose of the present invention, as embodied and broadly described herein, there is provided a gas suction apparatus for a reciprocating compressor comprising a piston having a gas flowing passage where refrigerant gas flows, being inserted in the compression space formed in a cylinder enabling linear reciprocating movement, a fixing means combined to the piston, an inertia valve including a valve cone portion formed to have a larger area than the cross section of the gas flowing passage and a certain thickness, for opening and closing the gas flowing passage, being contacted on the end surface of the piston or separated, a valve body portion extended having a smaller outer diameter than the inner diameter of the gas flowing passage at the center of the one side surface of the valve cone portion and inserted in the gas flowing passage, a plurality of guide members extended to have a certain length on the outer circumferential surface of the valve body portion and contacted on the inner circumferential surface of the gas flowing passage and an inertia valve penetrated-formed to have a certain width and length in the valve body portion having the fixing means inserted in the valve.

The foregoing and other, features, aspects and advantages of the present invention will become more apparent from the following detailed description when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
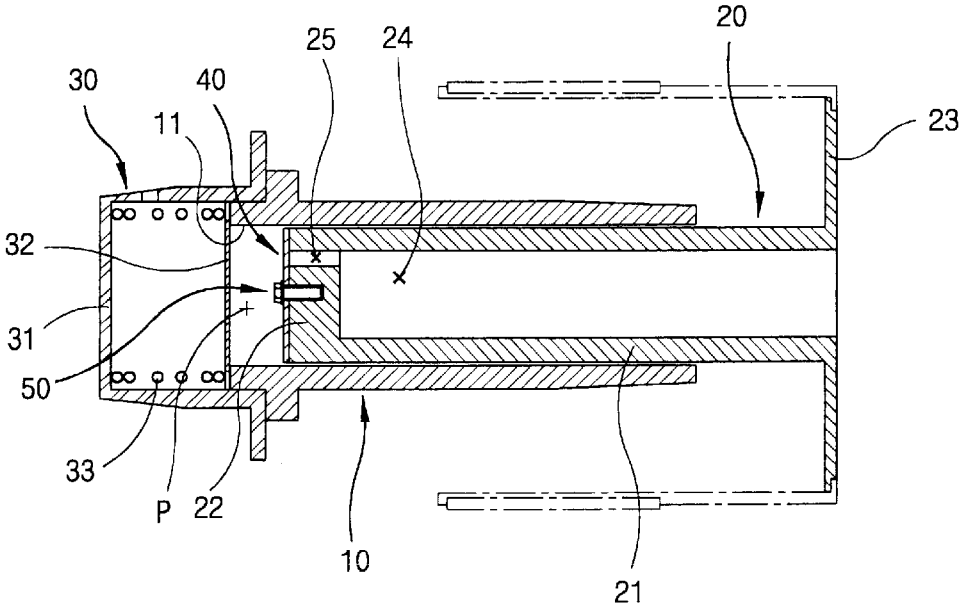
FIG.1 CONVENTIONAL ART
FIG. 1 is a cross-sectional view showing a compressing unit of a conventional reciprocating compressor.
Figure 2:
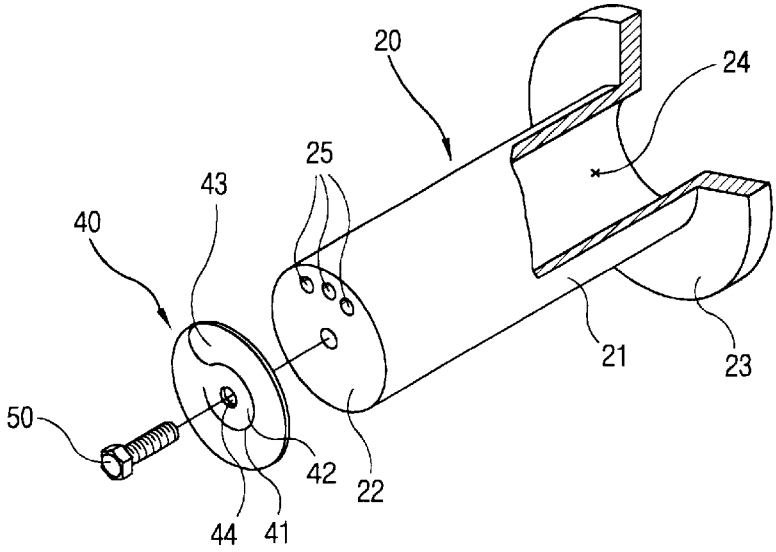
FIG.2 CONVENTIONAL ART
FIG. 2 is a partial perspective view showing an embodiment of a valve combining structure of the conventional reciprocating compressor.
Figure 3:
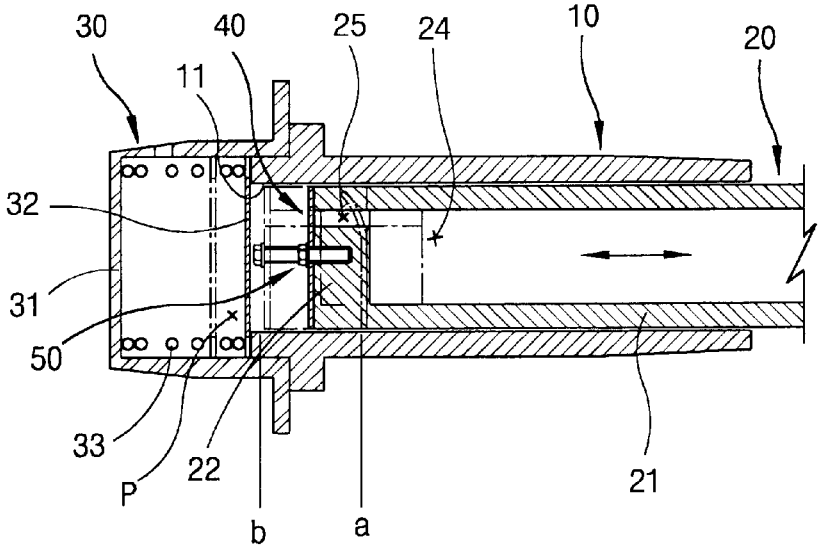
FIG.3 CONVENTIONAL ART
FIG. 3 is a cross-sectional view showing an operational condition of the compressing unit of the conventional reciprocating compressor.
Figure 4:
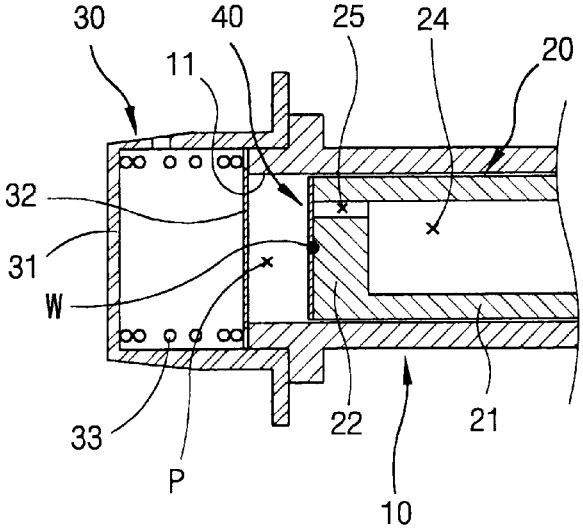
FIG.4 CONVENTIONAL ART
FIG. 4 is a cross-sectional view showing another embodiment of the valve combining structure of the conventional reciprocating compressor.

Reference will now be made in detail to the preferred embodiments of the present invention, examples of which are illustrated in the accompanying drawings.

Reference numeral which are same as the conventional art designates the same reference numeral and the description will be omitted.

Figure 5:
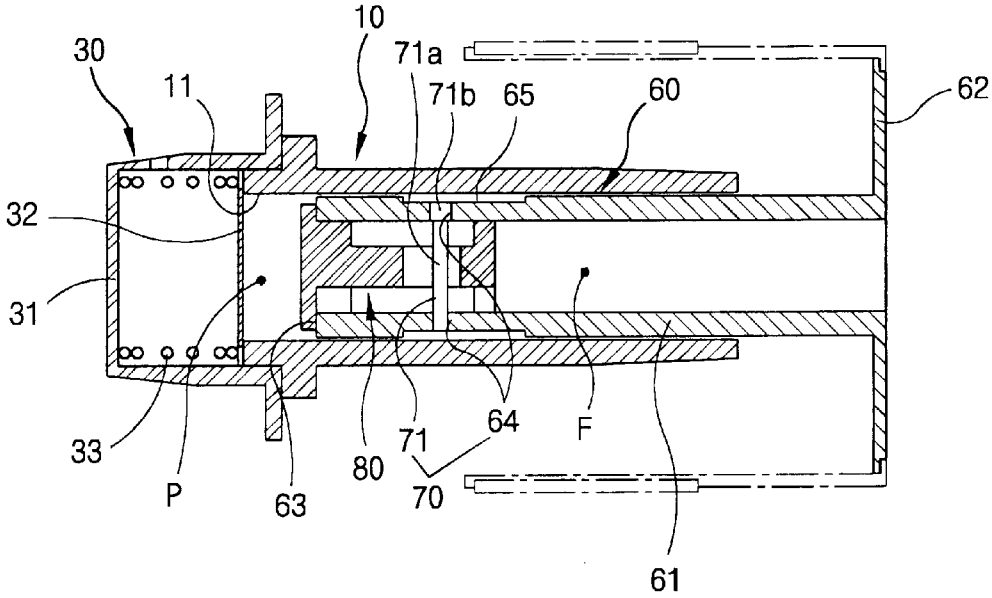
FIG. 5 is a cross-sectional view showing a compressing unit of a reciprocating compressor having a gas suction apparatus for a reciprocating compressor in accordance with the present invention.

FIG. 5 is a cross-sectional view showing a compressing unit of a reciprocating compressor having a gas suction apparatus for a reciprocating compressor in accordance with the present invention. As shown in FIG. 5, The compressing unit of the reciprocating compressor includes a cylinder 10 where a through hole 11 forming a compression space P inside the hole is formed, a piston having a gas flowing passage where refrigerant gas flows, being inserted in the compression space formed in a cylinder enabling linear reciprocating movement, a discharge valve assembly 30 combined to the end portion of the cylinder 10 to cover the through hole 11, a fixing means 70 combined to the piston 60 and an inertia valve 80 inserted in the gas flowing passage F movably to have a restricted moving distance by the fixing means 70, for opening and closing the gas flowing passage F moving according to pressure difference and inertia generated by linear reciprocating movement of the piston 60.

Here, the piston 60 has a certain length, a gas flowing passage F penetrated having a certain inner diameter is formed at the center of the body portion 61 formed in an annual bar form and a connection portion 62 extended along the circumferential direction having a certain area is formed at one side of the body portion 61.

The end surface of the piston body portion 61 positioned at the opposite side of the connection portion 62 is formed as a flat surface forming a sealing surface 63 and the connection portion 62 is connected to the driving unit for generating a driving force.

The fixing means 70 includes a pin combining hole 64 penetrated-formed at one side of the piston 60 to cross the gas flowing passage F of the piston 60 and a fixing pin 71 inserted-fixed to the pin combining hole 64, for restricting the moving distance of the inertia valve 80.

The fixing pin 71 includes a pin portion 71*a* having a certain outer diameter and length and a head portion 71*b* formed to have a certain length and an outer diameter larger than that of the pin portion 71*a* at one side of the pin portion 71*a*.

It is desirable that the pin combining hole 64 formed in the body portion 61 of the piston 60 is formed to have a different inner diameter so that the fixing pin 71 can be inserted and a stepped portion 65 is formed on the outer circumferential surface of the piston body portion 61 where the pin combining hole 64 is formed not to be contacted on the inner circumferential surface of the cylinder 10 when it is operated.

Figure 6:
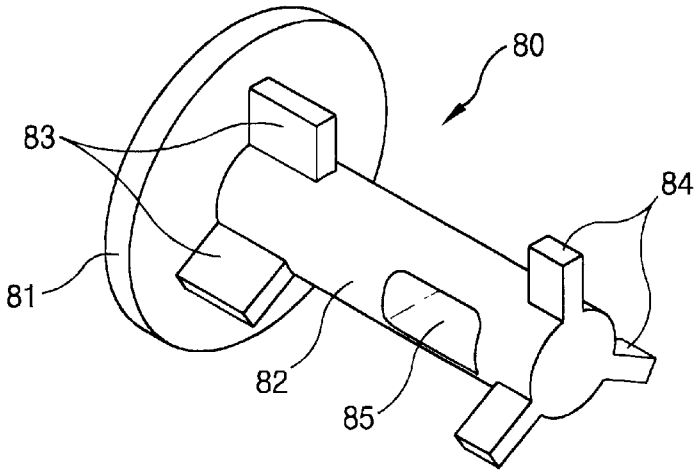
FIG. 6 is a perspective view showing an inertia valve composing the gas suction apparatus for the reciprocating compressor in accordance with the present invention.

Also, as shown in FIG. 6, the inertial vale 80 includes a valve cone portion 81 having a larger area than the cross section of the gas flowing passage F and a certain thickness, for opening and closing the gas flowing passage F, being contacted on the end surface of the piston 60 or separated, a valve body portion 82 extended having a smaller outer diameter than the inner diameter of the gas flowing passage F at the center of the one side surface of the valve cone portion 81 and inserted in the gas flowing passage F, a plurality of guide feet 83 and 84 extended to have a certain length on the outer circumferential surface of the valve body portion 82 and contacted on the inner circumferential surface of the gas flowing passage F and a guide hole 85 penetrated-formed having a certain width and length, in which the fixing means 70 are inserted.

The guide feet 83 and 84 include a plurality of front guide feet 83 formed on an outer circumferential surface at a side of the valve body portion 82 at a certain interval to be positioned at the side of the valve cone portion 81 and a plurality of rear guide feet 84 formed at the other side of the guide hole 85 having a certain distance from the front guide feet 83.

It is desirable that the front guide feet 83 are formed contacted on the portion ranged from the outer circumferential surface of the valve body portion 82 to the inner side surface of the valve cone portion 81 to increase the structural strength.

The front guide feet 83 are radially formed at a certain interval in the circumferential direction of the valve body portion 82 and the rear guide feet 84 are radially formed at a certain interval in the circumferential direction of the valve body portion 82.

It is desirable that the numbers of the front guide feet 83 and the rear guide feet 84 are formed same and the direction is formed to be positioned on a same line in the shaft direction of the valve body portion 82.

Also, the end surface of the guide feet 83 and 84 contacted with the inner circumferential surface of the piston 60 is formed in a square surface.

The guide member can further include a plurality of middle guide feet 830, 850 radially formed on the circumferential surface of the piston 60 between the front guide feet 83 and the rear guide feet 84 along the same circumferential direction.

Figure 8:
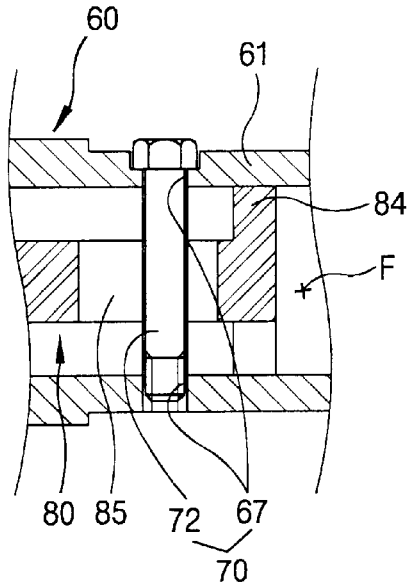
FIG. 8 is a cross-sectional view showing another embodiment of a fixing means composing the gas suction apparatus for the reciprocating compressor in accordance with the present invention.
Figure 9:
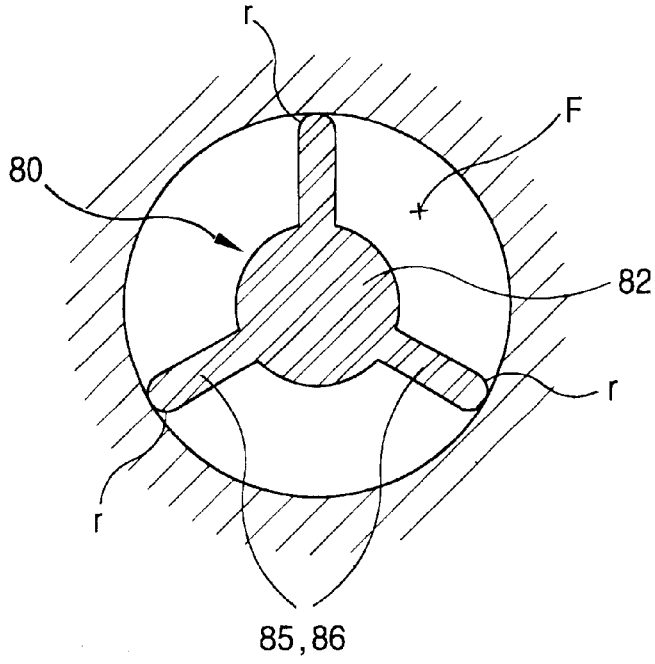
FIG. 9 is a cross-sectional view showing another modified example of a guide feet composing the gas suction apparatus for the reciprocating compressor in accordance with the present invention.

The middle guide feet 830, 850 can be respectively positioned on the same line along the shaft direction of the valve body portion 82 where the front guide feet 83 and the rear guide feet 84 are formed, as shown in FIG. 8, or the middle guide feet 830, 850 can be formed on a dislocated line from the shaft direction for better guidance, as shown in FIG. 9.

On the other hand, in the inertia valve 80, the inner surface of the valve cone portion 81 is contacted-combined on the sealing surface 63 of the piston 60 as the lengthy portion 82 and guide feet 83 and 84 are inserted to the gas flowing passage F of the piston 60.

At this time, the guide feet 83 and 84 are contacted-supported on the inner circumferential surface of the gas flowing passage F.

Under the condition that the guide hole 85 of the inertia valve 80 and the pin combining hole 64 formed at the piston 60 are unified, the fixing pin 71 Composing the fixing means 70 is penetrated inserted and fixed-combined to the pin combining hole 64 of the piston 60 and the guide hole 85 of the inertia valve 80.

Since a fixing pin 71 is inserted in the guide hole 85 in the inertia valve 80, moving distance is limited by the fixing pin 71.

Figure 7:
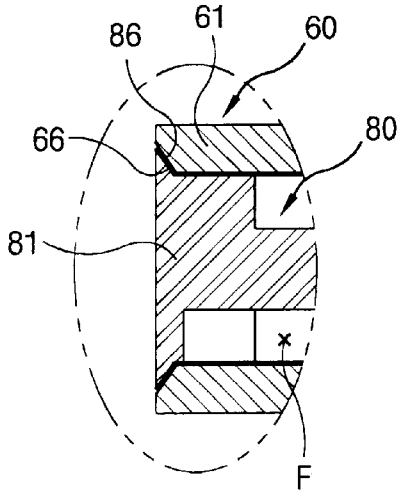
FIG. 7 is a cross-sectional view showing an embodiment of another valve cone portion of the inertia valve composing the gas suction apparatus for the reciprocating compressor in accordance with the present invention.

On the other hand, as shown in FIG. 7, in the other embodiment of the sealing structure between the valve cone portion 81 of the inertia valve 80 and the end surface of the piston body portion 61, a chamfered inclination contact surface 66 is formed on the border of the gas flowing passage F positioned on the end surface of the piston 60 and an inclination contact surface 86 which is formed to be contacted on the above inclination contact surface 66 is formed on the inner border of the valve cone portion 81 of the inertia valve 80.

Also, as shown in FIG. 8, the other embodiment of the fixing means 70 includes a bolt combining hole 67 penetrated-formed at one side of the piston 60 to cross the gas flowing passage F of the piston 60 and a fixing bolt 72 combined to the bolt combining hole 67, for restricting the moving distance of the inertia valve 80.

On the other hand, as shown in FIG. 9, the guide feet 83 and 84 are formed in the same position and shape as above but the feet can be formed as transformed guide feet 85 and 86 having the end surface meeting with the inner circumferential surface of the piston 60 forming a curved surface r, thus to move more smoothly.

Also, the guide feet are formed at both sides of the valve body portion 82 but the guide feet can be formed having more guide feet at the center portion of the lengthy portion 82 to perform more smooth and reliable movement.

The discharge valve assembly 30 includes a discharge cover 31 combined to cover the through hole 11 of the cylinder 10, a discharge valve 32 inserted in the discharge cover 31 and formed by the through hole 11 and the piston 60 of the cylinder 10, for opening and closing the compression space P and a valve spring 33 for supporting the discharge valve 32 elastically.

Hereinafter, the operation and effect of the gas suction apparatus for the reciprocating compressor in accordance with the present invention will be described.

Firstly, the operation of the compressing unit of the reciprocating compressor is performed as follows. When driving force of the driving unit is transmitted to the piston 60 and the piston 60 performs linear reciprocating movement inside the cylinder 10, namely, between the top dead center (b) and the bottom dead center (a) of the compression space P, the inertia valve 80 performs linear reciprocating movement by pressure difference of the compression space P of the cylinder 10 and inertial of the inertia valve 80 and opens and closes the gas flowing passage F of the piston 60. Accordingly, refrigerant gas is sucked to the compression space P of the cylinder 10 through the gas flowing passage F of the piston 60 and the gas is compressed and discharged by the opening and closing performance of the discharge valve 32 which composes a discharge valve assembly 30.

Figure 10:
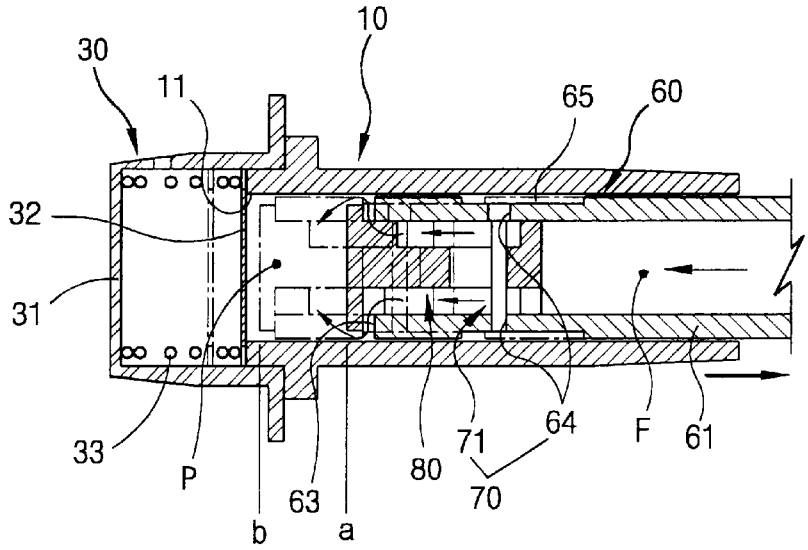
FIG. 10 is a cross-sectional view showing an operational condition of the compressing unit in a suction operation of the compressor having the gas suction apparatus for a reciprocating compressor in accordance with the present invention.

In the process, first, when the piston 60 moves to the bottom dead center (a), as shown in FIG. 10, under the condition that the inner surface of the valve cone portion 81 of the inertia valve 80 and the sealing surface 63 of the piston 60 is opened by pressure difference of the inner and outer portion of the compression space P and stop inertia of the inertia valve 80, the inertia valve 80 is caught by the fixing pin 71 which is the fixing means 70 and moves to the bottom dead center (a) together with the piston 60 and at the same time, the refrigerant gas flows through the gas flowing passage F of the piston 60. Then the refrigerant gas passes through the space between the outer circumferential surface of the valve body portion 82 of the inertia valve 80 and the inner wall of the gas flowing passage F and is sucked to the compression space of the cylinder 20 through the portion between the inner surface of the valve cone portion 81 of the inertia valve 80 and the sealing surface 63 of the piston 60.

Figure 11:
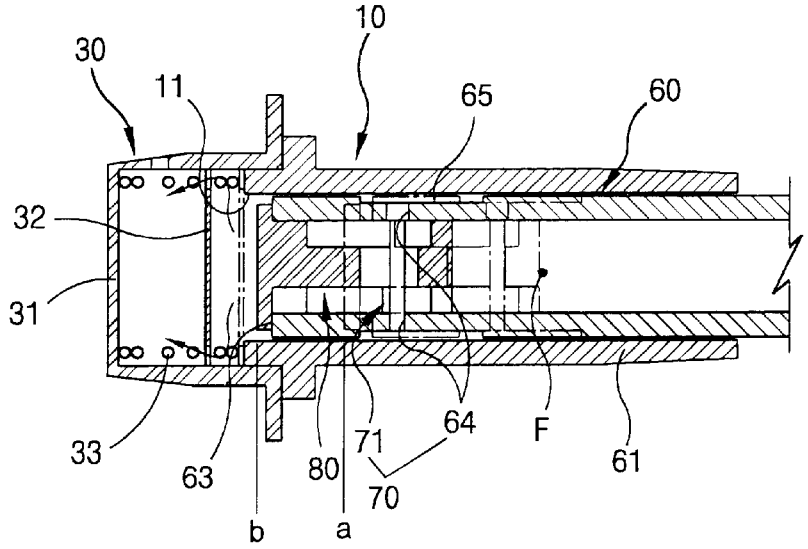
FIG. 11 is a cross-sectional view showing an operational condition of the compressing unit in a compressing operation of the compressor having the gas suction apparatus for a reciprocating compressor in accordance with the present invention.

As shown in FIG. 11, when the piston 60 moves from the bottom dead center (a) to the top dead center (b), by inertia of the inertia valve 80, pressure difference and movement of the piston 60, the fixing pin 71 which is a fixing means 70 moves along the guide hole 85 of the inertia valve 80 and supports the inner wall of the guide hole 85. The inner surface of the valve cone portion 81 of the inertia valve 80 is contacted on the sealing surface 63 of the piston 60 and the gas flowing passage F of the piston 60 is blocked. Accordingly, refrigerant gas sucked to the compression space P of the cylinder 10 is compressed as the piston moves to the top dead center (b).

Then, when the piston 60 reaches the top dead center (b), the discharge valve 32 is opened and the refrigerant gas sucked to the compression space P of the cylinder 10 is discharged.

As the above process is repeated, the refrigerant gas is sucked, compressed and discharged.

On the other hand, as the piston 60 performs linear reciprocating movement, in the process that the inertia valve 80 performs linear reciprocating movement in the gas flowing passage F of the piston 60, since the guide feet 83, 84, 85 and 86 of the inertia valve 80 are contacted-supported on the inner circumferential surface of the gas flowing passage F, the inertia valve 80 can move uniformly without slanting to a side and rotary movement of the inertia valve 80 is restricted by the fixing means 70.

Also, since the surface of the valve cone portion 81 of the inertia valve 80 positioned at the compression space P of the cylinder 10 is formed in a flat form in the apparatus in accordance with the present invention, dead volume of the compression P is minimized and position sensing of the stroke of the piston 60 becomes easier, thus to ease stroke controlling of the piston 60. Namely, in the present invention, since the dead volume generated by the head portion of the fixing bolt 50 is excluded in combining the fixing bolt 50 as conventionally, the compression space P is relatively larger and position sensing of the stroke of the piston 60 is easy.

Also, with the present invention, since the inertia valve 80 has a certain volume and weight, the structural strength is increased and the design of the cross section of the gas passage 25 where refrigerant gas flows is not limited. Namely, conventionally, the cross section of the gas passage 25 where refrigerant gas flows is designed according to strength of the suction valve 40 using the suction valve 40 formed as a thin plate and accordingly, design for increasing the cross section of the inertia valve 80 is limited. However, in accordance with the present invention, by applying the gas passage 25 limit in designing the gas passage according to strength of the suction valve 40 is removed.

Also, in accordance with present invention, since an opening amount of the inertia valve 80 is limited by the fixing means 70, reliability of response of the inertia valve 80 becomes excellent and the refrigerant gas can be sucked and flown smoothly.

As described above, the gas suction apparatus for the reciprocating compressor can minimize the dead volume of the compression space and control the stroke easily. Refrigerant gas is smoothly sucked and flown by excellent reliability of response of the valve and compressing performance can be improved. Also, damage of the components is restricted by increasing the structural strength, thus to improve reliability of the compressor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A gas suction apparatus for a reciprocating compressor, comprising:

a piston having a gas flowing passage where refrigerant gas flows, being inserted in the compression space formed in a cylinder enabling linear reciprocating movement;

an inertia valve; and fixing means combined to the piston for restricting reciprocating motion of the inertia valve, the inertia valve including:

a valve cone portion formed to have a larger area than the cross section of the gas flowing passage and a certain thickness, for opening and closing the gas flowing passage, being contacted on the end surface of the piston or separated;

a valve body portion extended having a smaller outer diameter than the inner diameter of the gas flowing passage at the center of the one side surface of the valve cone portion and inserted in the gas flowing passage;

a plurality of guide members extended to have a certain length on the outer circumferential surface of the valve body portion and contacted on the inner circumferential surface of the gas flowing passage; and a guide hole formed to have a certain width and length in the valve body portion having the fixing means inserted in the inertia valve.

2. The apparatus of claim 1, wherein the piston comprises:

a body portion formed in an annual bar shape having a certain length and having a gas flowing passage penetrating a certain inner diameter at the center;

a connection portion extended along the circumferential direction having a certain area at a side of the body portion; and a pin hole formed at a side portion of the body portion to be combined with the fixing means.

3. The apparatus of claim 1, wherein the guide member comprises:

a plurality of front guide feet formed on an outer circumferential surface of the valve body portion to be positioned at the valve cone portion side; and a plurality of rear guide feet formed on the outer circumferential surface of the valve body portion positioned at the guide hole side having a certain interval from the front guide feet.

4. The apparatus of claim 3, wherein the front guide feet are formed to contact the outer circumferential surface of the valve body portion and the inner side surface of the valve cone portion simultaneously.

5. The apparatus of claim 3, wherein the guide member further comprises:

a plurality of middle guide feet radially formed on the piston between the front guide feet and the rear guide feet.

6. The apparatus of claim 5, wherein the middle guide feet are respectively positioned on lines extending parallel to the valve body portion between the front guide feet and the rear guide feet.

7. The apparatus of claim 5, wherein the middle guide feet are respectively positioned at locations dislocated from lines extending parallel to the valve body portion from the front guide feet to the rear guide feet.

8. The apparatus of claim 1, wherein the sectional shape of the outer end surface of the guide members is correspondent to a curvature radius of the inner circumferential surface of the gas flowing passage formed in the piston.

9. The apparatus of claim 1, wherein the fixing means comprises:

a pin hole formed at one side of the piston to cross the gas flowing passage of the piston; and a fixing pin inserted in the inertia valve and fixed in the pin hole, for restraining moving distance of the inertia valve.

10. The apparatus of claim 1, wherein the fixing means comprises:

a bolt hole formed at one side of the piston to cross the gas flowing passage of the piston; and a fixing bolt inserted in the inertia valve and combined to the bolt hole, for restraining moving distance of the inertia valve.

* * * * *